United States Patent [19]

Gnaga

[11] 4,177,824

[45] Dec. 11, 1979

[54] DEVICE FOR AUTOMATIC HAIR CURLING

[76] Inventor: Vittorio Gnaga, Via Boccaccio 4, Milan, Italy

[21] Appl. No.: 858,377

[22] Filed: Dec. 7, 1977

[30] Foreign Application Priority Data

Dec. 20, 1976 [IT] Italy ..... 30639 A/76

[51] Int. Cl.[2] ..... A45D 2/12

[52] U.S. Cl. ..... 132/34 R

[58] Field of Search ..... 132/34 R, 9, 5, 34 B; 46/242

[56] References Cited

U.S. PATENT DOCUMENTS

| | | | |
|---|---|---|---|
| 3,057,363 | 10/1962 | Talbot | 132/34 R X |
| 3,533,421 | 10/1970 | Mays | 132/34 R |
| 4,038,996 | 8/1977 | Eronini | 132/9 |

FOREIGN PATENT DOCUMENTS

| | | | |
|---|---|---|---|
| 1782830 | 7/1973 | Fed. Rep. of Germany | 132/9 |

*Primary Examiner*—G.E. McNeill

*Attorney, Agent, or Firm*—Wenderoth, Lind & Ponack

[57] ABSTRACT

A device for automatically curling hair includes a dome-shaped housing having an inlet opening and a longitudinal axis. A fixed rod having a heater therein is immovably positioned coaxially within the housing. A driving rod is positioned within the housing at a location radially outwardly spaced from the fixed rod and is rotated in a path about the fixed rod. A spiral-shaped member is positioned eccentrically about the fixed rod and has an end fixed to the driving rod. Rotation of the driving rod causes the spiral-shaped member to eccentrically rotate about the fixed rod.

9 Claims, 2 Drawing Figures

DEVICE FOR AUTOMATIC HAIR CURLING

BACKGROUND OF THE INVENTION

This invention relates to a device for automatic hair curling.

It is well known that the problem of automatically curling human hair has always been solved with remarkable difficulties, especially due to the delicate material to be subjected to an automatic treatment and to the variability of physical-chemical properties thereof, as well as of the mechanical resistance of the hair.

In view of the aforementioned difficulties, the attempts made hitherto for eliminating such problem did not bring about a favourable result, in part because such attempts were represented by too complicated and consequently very expensive and delicate devices. An exception to the above is an electric-mechanical curling device, patented by the applicant of the present invention. Such device provides an electrically controlled comb-like rotating means which co-operates with a central heating element around which the hair lock to be curled is wound, thereby obtaining a curly formation, without any fear of having the hair torn or pulled by the device.

SUMMARY OF THE INVENTION

The present invention provides a device for automatically curling hair with perfect performance and which has a particularly efficient structure as the electrical-mechanical part and a case-like carrier. The device according to the present invention is characterized in that it comprises, within a special case-like covering, preferably made of insulating material, motor means adapted to drive depending curling means which produce, by means of their structure and movement, an intake action which in turn causes advancement and winding of the hair lock around a stationary element, preferably electrically heated, in such a manner that the combination of the intake and said mechanical action provides curling of the hair under treatment.

The fundamental concept above disclosed is favourable for different embodiments, both with regard to the structure of the assembled device and its individual components as well as to the respective arrangement thereof, and all such variants which are within the scope of the invention.

According to a preferred embodiment of the invention, the curling means are formed by at least one spiral-shaped tape-like element, the ends of which are attached to a driving rod, such element being arranged in a dome-shaped housing which has ink outwardly facing opening defined by means of a preferably axially toothed inlet. Air together with a hair lock are sucked inwardly through the inlet, and the hair lock is wound around a stationary element in the form of a rod coinciding with the axis of the dome-shaped housing, while the driving rod is eccentric with respect to the stationary rod.

Advantageously, the driving shaft of the electric motor of the curling element is misaligned with respect to the dome-shaped housing axis. A suitable kinematic connection is provided between the motor shaft and the driving rod, and preferably is in the form of a motor pinion keyed to the electric motor shaft and of a driven crown gear, the teeth thereof being in mesh with the teeth of the pinion. The rotating axis of the crown gear coinciding with the housing axis or with the axis of an electrically heated stationary element. The pinion-crown gear meshing causes a suitable reduction of the motor rotation speed and, consequently a suitably reduced rotation of the angular speed of the driving rod having the tape-like element.

These and other features of the invention will be explained in the following description with reference to the attached drawings, while description and drawing are only indicative and not limitative to the protective range of the invention.

DETAILED DESCRIPTION OF THE INVENTION

Figure 2:
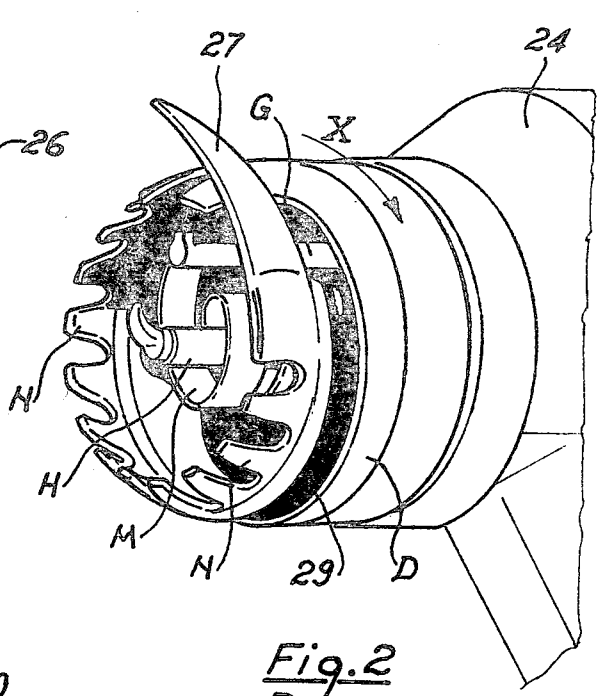
FIG. 2 is a perspective view of the front part only of the device.
Figure 1:
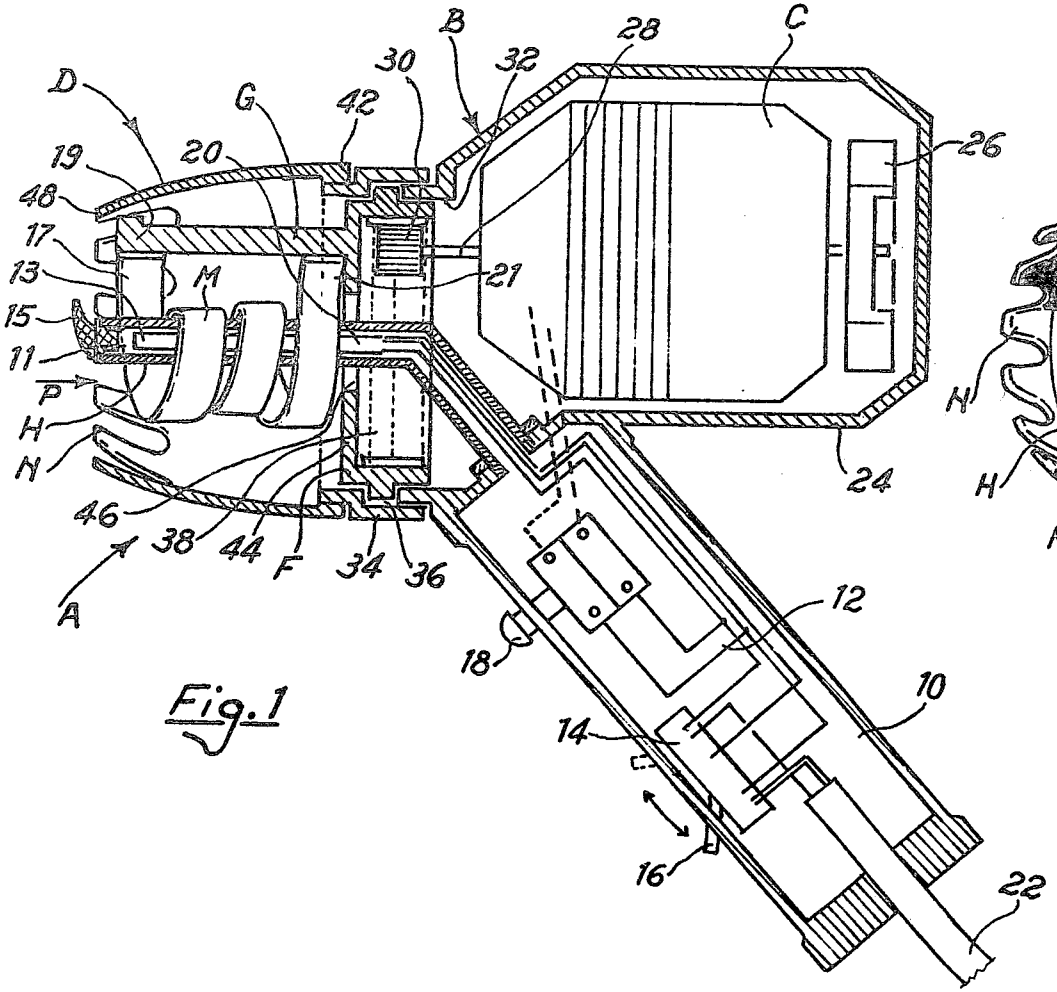
FIG. 1 is a side view, in section taken along a median plane, of the curling device of the invention.

Referring now to FIGS. 1 and 2 of the drawings, there can be seen the automatic curling device A of the electromechanical type, which can easily be held by grip 10 which retains and supports the device body B, in this case the grip being inclined relative to body B.

Both grip and body may be produced of a suitable electrically insulating material, e.g. pressed plastic material. The hollow handgrip 10 also serves as a container for the electric parts 12, switch 14, the lever 16 thereof connecting or disconnecting the feeding circuit of resistor 13, and the knob 18 for connecting and disconnecting the electromotor, as will be described in detail furtheron. The electric wire 22, appropriately insulated, arrives to the handgrip 10.

Body B has at the rear part thereof a case-like chamber 24, wherein there is arranged an electromotor C equipped with a cooling fan 26, the motor being suitably secured to the chamber and having a driving shaft 28 extending along the axis of the chamber itself. The front end of the driving shaft has keyed thereto a pinion 30 provided with a suitable number of teeth.

The chamber 24 terminates at the front part in a cylindrical mouth-piece 32, the edge of a respective stop ring 34 engaging therearound, while a suitably structurized housing D extends frontwardly therefrom. A cylindrical seat 36 is defined by ring 34 and portion 32, forming a guide means for rollingly guiding a crown gear F which has an internal toothing 38 having a suitable number of teeth in engagement with the teeth of pinion 30. The attachment of ring 34 to portion 32, and of zone 42 of housing D to ring 34, may be done in any suitable way, e.g. by screwing or shrinking or the like.

A circular wall 44 of crown gear F is provided with a central hole 46, and the axis of hole 46 coincides with that of housing D and therefore is eccentric with respect to the axis of motor shaft 28. From wall 44 extends an element G forming a driving rod which is obviously misaligned with respect to the rotation axis of crown gear F, rod G being parallel to the motor shaft 28 and having suitable dimensions, particularly such a length as to not project from the end portion 48 of housing D.

An element H, formed by a core or a hollow pin, passes through the central hole 46 of crown gear F and is stationary. Element H extends from the handgrip 10 and is coaxial with respect to the housing D. A recess 11 of hollow pin H contains the resistor 13 for heating the hair lock, while recess 11 is closed by a shoe-like appendix 15 elastically oscillatable around the end portion of pin H, in order to assure regular retention of a hair lock under treatment on hollow pin H as well as easy stripping-off of the hair curl by elastically lowering the shoe-like appendix.

The driving rod G has single spiral-shaped tape-like element M, the end portions 17 and 21 of which thereof are secured to the end portions 19 of driving rod G, and element M is wound around pin H, with a considerable clearance, whereby the tape-like element M or curling means has considerable flexibility and elasticity and, as a consequence thereof, develops a soft mechanical action on the hair under treatment. It is not to be excluded that the element M might assume a different structure and have different features and have other similar curling means being alike or dissimilar from each other, and that could be extended from driving devices other than rod G.

As will be seen, the structure of housing G, advantageously made of a material having a certain stiffness, is rather uneven in that teeth are provided around the opening P of the housing. The teeth are shaped in such a manner that they will not harm or offend the cutis of the person using the device according to the invention, and consequently the teeth have a soft contour. The arrangement of teeth N terminates with a tile-shaped appendix 27, while a circular opening 29 is provided in housing D rearwardly of the teeth.

In view of the above, the use and the performance of the device according to the invention appear obvious and are summarized in the following. It is stated beforehand that automatic curling is effected in a characteristic way by winding the hair from the root to the tip in two different manners in dependence on the hair length.

The part of device A which contacts the hair, is so designed that, in the case of short hair, it will be sufficient to lay the device on the cutis, while in the case of long hair, a hair lock has to be introduced into the mouth-piece formed by the opening 29 are limited by appendix 27.

The electromotor C is started by means of pushbutton 18, its shaft will rotate in order that the driving rod G will effect clockwise rotation, i.e., in the direction indicated by arrow X, around the hollow pin H. The rotation of shaft 28, with with a desired number of revolutions, and hence of rod G, will cause rotation of the spiral-shaped, tape-like element M which, in combination with housing D, defines a kind of fan volute, thereby producing a pneumatic action by which air entering through inlet P is sucked from the housing. Consequently, the hair is sucked, conveyed and wound around the stationary central pin H (heated by resistor 13), whereby it will be more or less strongly curled depending on the time of interval the user will choose by stopping the motor, once the hair lock is wound around the stationary pin. The hair lock is completely free to come off in the axial direction, at any instant, before, during and at the end of rotation of the motor. The operation will be repeated as long as partial curling or entire curling of the hair to be styled has not been performed. The thus obtained curling will be stronger towards the hair tips, since it begins at the hair root. Performance of flat ringlets, curls and the like is possible. The device according to the invention also provides the possibility of curling most easily and quickly very short hair, such as a hairdresser only could previously do with success and a great deal of patience.

In practice, the particulars of accomplishment and construction of the device according to the invention may vary without departing from the scope of the present invention.

I claim:

1. A device for automatically curling hair, said device comprising:

a dome-shaped housing having an inlet opening and a longitudinal axis;

a fixed rod immovably positioned coaxially within said housing;

heating means immovably positioned within said fixed rod;

a driving rod positioned within said housing at a position spaced radially outwardly from said fixed rod;

a spiral-shaped tape-like member positioned within said housing and eccentrically about said fixed rod, said spiral-shaped member having at least one end fixed to said driving rod; and driving means, operatively connected to said driving rod, for moving said driving rod in a path coaxially about said fixed rod, and for thus rotating said spiral-shaped member eccentrically about said fixed rod, thereby creating a suction through said inlet opening, such that the combined action of said rotating spiral-shaped member and said suction operates to wind a lock of hair, introduced into said housing through said inlet opening, around said fixed rod.

2. A device as claimed in claim 1, wherein that portion of said housing defining said inlet opening is formed with teeth extending generally axially parallel to said axis.

3. A device as claimed in claim 2, wherein said housing portion formed with said teeth substantially circumferentially terminates with a generally pointed appendix, said appendix and at least a part of said housing portion formed with said teeth are axially separated from the remainder of said housing by a generally peripherally extending aperture.

4. A device as claimed in claim 1, wherein said driving means comprises an electric motor having an output shaft eccentrically aligned with respect to said housing axis, and coupling means for mechanically transferring rotation of said output shaft about the axis thereof to rotation of said driving rod in said path.

5. A device as claimed in claim 4, wherein said coupling means comprises a crown gear positioned to rotate coaxially of said housing axis, said driving rod being integral with and extending from said crown gear, and a pinion gear fixed to said output shaft and having teeth meshing with teeth of said crown gear.

6. A device as claimed in claim 5, wherein said teeth of said crown gear are positioned internally thereof.

7. A device as claimed in claim 5, wherein said crown gear has therein a central axial opening through which extends said heating means.

8. A device as claimed in claim 5, wherein the axes of said output shaft, said crown gear and said heating means are parallel.

9. A device as claimed in claim 5, further comprising a body member housing said electric motor and having a handgrip, said body member having a cylindrical opening axially aligned with said housing and joined thereto by an intermediate ring member, said body member and said ring member defining therebetween a cylindrical seat, and said crown gear having an outer cylindrical surface rollingly guided within said cylindrical seat.

* * * * *